US009042765B2

(12) United States Patent
Kang et al.

(10) Patent No.: US 9,042,765 B2
(45) Date of Patent: May 26, 2015

(54) IMAGE FORMING APPARATUS WITH IMPROVED HEAT TRANSMISSION

(71) Applicant: SAMSUNG Electronics Co., Ltd., Suwon-si, Gyeonggi-do (KR)

(72) Inventors: Il Kwon Kang, Suwon-si (KR); Hwan Jin Yoon, Suwon-si (KR); Jeong Jae Seong, Namyangju-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 10 days.

(21) Appl. No.: 13/740,336

(22) Filed: Jan. 14, 2013

(65) Prior Publication Data

US 2013/0183060 A1 Jul. 18, 2013

(30) Foreign Application Priority Data

Jan. 16, 2012 (KR) ..... 10-2012-0004838

(51) Int. Cl.
*G03G 21/20* (2006.01)

(52) U.S. Cl.
CPC ..... *G03G 21/20* (2013.01)

(58) Field of Classification Search
CPC ..... G03G 21/20; G03G 15/04; G03G 21/16; G03G 15/0898; G03G 15/0225
USPC ..... 399/92–95, 98, 100, 107
See application file for complete search history.

(56) References Cited

U.S. PATENT DOCUMENTS

| | | | | |
|---|---|---|---|---|
| 6,548,264 | B1 | 4/2003 | Tan et al. | |
| 2003/0053818 | A1 * | 3/2003 | Kimura | 399/94 |
| 2004/0067503 | A1 | 4/2004 | Tan et al. | |
| 2004/0101822 | A1 | 5/2004 | Wiesner et al. | |
| 2005/0090732 | A1 | 4/2005 | Ivkov et al. | |
| 2005/0208100 | A1 | 9/2005 | Weber et al. | |
| 2005/0232653 | A1 * | 10/2005 | Murooka | 399/92 |
| 2005/0271732 | A1 | 12/2005 | Seeney et al. | |
| 2006/0148104 | A1 | 7/2006 | Marini et al. | |
| 2006/0204435 | A1 | 9/2006 | Stuart | |
| 2006/0251726 | A1 | 11/2006 | Lin et al. | |
| 2006/0275791 | A1 | 12/2006 | Belcher et al. | |
| 2007/0042431 | A1 | 2/2007 | Urdea et al. | |
| 2007/0264199 | A1 | 11/2007 | Labhasetwar et al. | |
| 2008/0045736 | A1 | 2/2008 | Ying et al. | |

(Continued)

FOREIGN PATENT DOCUMENTS

| | | |
|---|---|---|
| KR | 1020070095529 | 10/2007 |
| WO | WO2005044224 | 5/2005 |

(Continued)

OTHER PUBLICATIONS

Boyer C., et al., The design and utility of polymer-stabilized iron-oxide nanoparticles for nanomedicine applications, NPG Asia Mater 2(1), 23-30 (2010).

(Continued)

*Primary Examiner* — Hoang Ngo

(74) *Attorney, Agent, or Firm* — Staas & Halsey LLP

(57) ABSTRACT

An image forming apparatus includes a developing unit to form a visible image on a printing medium using developer, a fixing device to fix the developer to the printing medium, and a heat plate placed between the developing unit and the fixing device such that heat generated from the fixing device is absorbed by the heat plate, and transmission of heat to the developing unit is restricted.

16 Claims, 4 Drawing Sheets

(56) References Cited

U.S. PATENT DOCUMENTS

| | | | | |
|---|---|---|---|---|
| 2008/0124281 | A1 | 5/2008 | Gao et al. | |
| 2008/0187349 | A1* | 8/2008 | Yoshihara et al. | 399/92 |
| 2008/0206150 | A1 | 8/2008 | Louie et al. | |
| 2008/0213377 | A1 | 9/2008 | Bhatia et al. | |
| 2008/0213382 | A1 | 9/2008 | Ivkov et al. | |
| 2008/0221043 | A1 | 9/2008 | Harth et al. | |
| 2008/0241266 | A1 | 10/2008 | Bringley et al. | |
| 2009/0075396 | A1 | 3/2009 | Deshong et al. | |
| 2009/0093551 | A1 | 4/2009 | Bhatia et al. | |
| 2009/0123366 | A1 | 5/2009 | Dobson et al. | |
| 2009/0169478 | A1 | 7/2009 | Leuschner et al. | |
| 2009/0214618 | A1 | 8/2009 | Schoenfisch et al. | |
| 2009/0297615 | A1 | 12/2009 | Wang et al. | |
| 2009/0306335 | A1 | 12/2009 | Harth et al. | |
| 2009/0317802 | A1 | 12/2009 | Bhatia et al. | |
| 2009/0325812 | A1 | 12/2009 | Mirkin et al. | |
| 2010/0008862 | A1 | 1/2010 | Fu et al. | |
| 2010/0015165 | A1 | 1/2010 | Landfester et al. | |
| 2010/0047356 | A1 | 2/2010 | Yu et al. | |
| 2010/0080788 | A1 | 4/2010 | Barnett et al. | |
| 2011/0222897 | A1* | 9/2011 | Makino | 399/92 |

FOREIGN PATENT DOCUMENTS

| | | |
|---|---|---|
| WO | WO2006050257 | 5/2006 |
| WO | WO2006128121 | 11/2006 |
| WO | WO2008005479 | 1/2008 |
| WO | WO2009097439 | 8/2009 |

OTHER PUBLICATIONS

Allia P. et al., Granular Cu-Co alloys as interacting superparamagnets, (2001) Phys. Rev. B. 64, 144420.
Arruebo M, et al., Antibody-Functionalized Hybrid Superparamagnetic Nanoparticles, (2007) Adv: Funct. Mater. 17, 1473-1479.
Aznar E, et al., pH- and phot-switched release of guest molecules from mesoporous silica supports, (2009) J. Am. Chem. Soc. 131, 6833-6843.
Bertoluzza A, et al., Raman and infrared spectra on silica gel evolving toward glass (1982) J. Non-Crys. Sol. 48, 117.
Casasus R, et al., Dual aperture control on pH- and anion-driven supramolecular nanoscopic hybrid gate-like ensembles (2008) J. Am. Chem. Soc. 130, 1903-1917.
Chattopadhyay P, Gupta RB., Supercritical CO2 based production of magnetically responsive micro- and nanoparticles for drug targeting, (2002) Ind. Eng. Chem. Res. 41, 6049-605.
Chukin G.D., Malevich V.I., Infrared spectra of silica (1977) J. Appl. Spectroscopy. 26, 223.
Climent E, et al., Controlled delivery systems using antibody-capped mesoporous nanocontainers (2009) J. Am. Chem. Soc. 131, 14075-14080.
Coluccla et al., Infrared study of surface modes on silica (1978) J. Phys. Chem. 82, 1298-1303.
Culler SR, Ishida H, Koenig JL. (1984) Appl. Spectroscopy. 38, 1.
Dormann JL, et al., (1997) Adv. Chem. Phys. 98, 283.
Duff DG, Baiker A, Edwards PP. (1993a) Langmuir. 9, 2301.
Duff DG, Baiker A, Gameson I, Edwards PP. (1993b) Langmuir. 9, 2310.
Fang C, et al., (2009) Small. 5, 1637.
Feng X, et al., (1997) Science. 276, 923.
Fernandez-Pacheco R, et al., (2006) Nanotechnology. 17, 1188.
Guerrero-Martinez A, et al., (2009) Adv. Mater. DOI: 10.1002/adma.200901263.
Gupta AK, et al., (2005) Biomaterials. 26, 3995.
Hetrick EM, et al., (2008) ACS Nano. 2, 235.
Hetrick EM, et al., (2009) Biomaterials. 30, 2782.
Higuchi WI. (1962) J.Pharm. Sci 51, 802.
Higuchi TJ. (1963) J.Pharm. Sci 52, 1145.
Jitianu A, et al., (2003) J. Non-Crys. Solids. 319, 263.
Kang K, et al., (2009) J. Phys. Chem. B. 113, 536.
Ma DL, et al., (2006) Chem. Mater. 18, 1920.
Mal NK, et al., (2003) Nature. 421, 350.
Morris JJ, Page MI. (1978) J.Chem. Soc. Chem. Commun. 591.
Nguyen TD, et al., (2007) Adv. Funct. Mater. 17, 2101.
Nguyen TQ, et al., (2000) Science. 288, 652.
Niu DC, et al., (2010) Adv. Funct. Mater. 20, DOI: 10.1002/adfm.200901493.
Qian HS, et al., (2009) Small. 5, 2285.
Park J, et al., (2004) Nature Mater. 3, 891.
Patel K, et al., (2008) J. Am. Chem. Soc. 130, 2382.
Santra S. et al., (2001) Langmuir. 17, 2900.
Sappey R, et al., (1997) Phys. Rev. B. 56, 14551.
Shin JH, et al., Synthesis of Mitric Oxide-Releasing Silica Nanoparticles (2007) J. Am. Chem. Soc. 129, 4612.
Slowing II, et al., (2007) Adv. Funct. Mater. 17, 1225.
Stamopoulos D, et al., (2008) Nanotechnology. 19, 505101.
Sun SH, et al., (2004) J. Am. Chem. Soc. 126, 273.
Thornton PD, Heise A. (2010) J. Am. Chem. Soc. 132, 2024.
Torney F, et al., (2007) Nature Nanotech. 2, 295.
Tsunekawa S, et al., (2000) Phys. Rev. Lett. 85, 3440.
Udenfriend S, et al., (1972) Science. 178, 871.
Vadalaa ML, et al., (2005) J. Magn. Magn. Mater. 293, 162.
Vallet-Regi M, et al., (2007) Angew. Chem., Int. Ed. 46, 7548.
Vargas JM, et al., (2005) Phys. Rev. B. 72, 184428.
Westcott SL, et al., (1988) Langmuir. 14, 5396.
Woo K, Hong J, Choi S, Lee HW, Ahn JP, Kim CS, Lee SW. (2004) Chem. Mater. 16, 2814.
Xu PS, et al., (2007a) Angew. Chem. Int. Ed. 46, 4999.
Xu ZC, Hou YL, Sun SH. (2007b) J. Am. Chem. Soc. 129, 8698.
Yi DK, Selvan ST, Lee SS. (2005) J. Am. Chem. Soc. 127, 4990.
Yoon TJ, et al., (2005) Angew. Chem. Int. Ed. 44, 1068.
Zhang XF, et al., (2007a) Nanotechnology. 18, 275701.
Zhang XF, et al., (2007b) Acta Materialia. 55, 3727.
Zhang M, et al., Synthesis and Characterization of Monodisperse Ultra-Thin Silica-Coated Magnetic Nanoparticles (2008) Nanotechnology. 19, 085601.
Zhao YN, et al., (2009a) J. Am. Chem. Soc. 131, 8398.
Zhao N, Gao MY. (2009b) Adv. Mater. 21, 184.
Zhou W, et al., (1998) Science. 280, 705.
Zhu Y, et al., Rattle-Type Fe3O4@SiO2 Hollow Mesoporous Spheres as Carriers for Drug Delivery, Small 2010, 6, No. 3, 471-478.
International Preliminary Report on Patentability of corresponding PCT Application No. PCT/CA2011/000684 mailed on Aug. 31, 2012.
International Search Report and Written Opinion of corresponding PCT Application No. PCT/CA2011/000684 mailed on Sep. 13, 2011.

* cited by examiner

IMAGE FORMING APPARATUS WITH IMPROVED HEAT TRANSMISSION

CROSS-REFERENCE TO RELATED APPLICATIONS

This application claims priority under 35 U.S.C. §119 from Korean Patent Applications No. 2012-0004838, filed on Jan. 16, 2012 in the Korean Intellectual Property Office, the disclosure of which is incorporated herein by reference in its entirely.

BACKGROUND OF THE INVENTION

1. Field of the Invention

Embodiments of the present general inventive concept relate to an image forming apparatus which includes a developing unit to develop a visible image on a printing medium using developer, and a fixing device to fix the developer image to the printing medium.

2. Description of the Related Art

Generally, image forming apparatuses are devised to form an image on a printing medium. Examples of image forming apparatuses include printers, copiers, fax machines, and devices combining functions thereof.

An image forming apparatus includes a developing unit to transfer a visible image, which has been developed using developer, to a printing medium, an exposure device to form an electrostatic latent image on a photoconductor of the developing unit by irradiating light to the photoconductor of the developing unit, and a fixing device to fix the developer image to the printing medium by applying heat and pressure thereto.

The image forming apparatus has an internal configuration in which the developing unit and the fixing device are arranged close to each other. As described above, however, the fixing device generates heat, and may cause decomposition of developer included in the developing unit when heat generated from the fixing device is transmitted to the developing unit.

The developing unit includes a charging device to charge the photoconductor via corona discharge. An operation of the charging device may inevitably generate discharge byproducts, such as ozone, nitrogen oxide, and the like. The discharge byproducts may contaminate the photoconductor that is arranged close to the charging device.

SUMMARY OF THE INVENTION

The present general inventive concept provides an image forming apparatus to restrict transmission of heat generated from a fixing device to a developing device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an image forming apparatus including a developing unit to form a visible image on a printing medium using developer, a fixing device to fix the developer image to the printing medium, and a heat plate placed between the developing unit and the fixing device.

The heat plate may include a shield section located between the developing unit and the fixing device, and a radiator section integrally extending from the shield section, the radiator section being cooled via heat exchange with air.

The heat plate may further include a connecting section to connect the shield section and the radiator section to each other.

The image forming apparatus may further include a blowing device to allow the radiator section to be cooled in contact with air.

The image forming apparatus may further include a main body defining an external appearance of the image forming apparatus, and the blowing device may include a blowing fan, a suction duct having a width equivalent to a width of the developing unit, into which air is suctioned from the developing unit, a connection duct to connect the suction duct and the blowing fan to each other, and a discharge duct to guide the air discharged from the blowing fan to an outside of the main body.

The radiator section may be located within the suction duct and be cooled by the air passing through the suction duct.

The developing unit may include a photoconductor, and a charging device to charge the photoconductor, and the blowing device may be configured to suction discharge byproducts generated from the charging device and discharge the discharge byproducts to the outside of the main body.

The suction duct may have a suction port at a position corresponding to the charging device, and the developing unit may include a developing housing provided with a discharge port at a position corresponding to the suction port, and the charging device may be located inside the discharge port of the developing housing.

The charging device may include a first electrode having a lattice shape, one surface of the first electrode being spaced apart from the photoconductor so as to face the photoconductor, and a second electrode having a pin shape, the second electrode being spaced apart from the other surface of the first electrode.

The shield section may include a plurality of heat absorbing ridges protruding toward the fixing device.

The radiator section may include a plurality of heat radiating ridges protruding into an internal path of the suction duct.

The foregoing and/or other features and utilities of the present general inventive concept may also be achieved by providing an image forming apparatus including a main body defining an external appearance of the image forming apparatus, a developing unit placed within the main body to form a visible image on a printing medium using developer, and a blowing device configured to suction air from the developing unit and discharge the air to an outside of the main body, wherein the developing unit includes a photoconductor and a charging device to charge the photoconductor, and the blowing device is configured to suction discharge byproducts generated from the charging device and discharge the discharge byproducts to the outside of the main body.

The foregoing and/or other features and utilities of the present general inventive concept may also be achieved by providing an image forming apparatus including a developing unit to form a visible image on a printing medium using developer, a fixing device to fix the developer image to the printing medium, and a heat plate having one end disposed close to the fixing device to receive heat from the fixing device and the other end extended from the one end toward a position away from the fixing device and the developing unit such that the heat is discharged away from the fixing device and the developing unit through the other end of the heat plate.

The apparatus may further include a blowing device disposed to generate an air flow, and the heat plate may be disposed in the air flow for heat exchange.

The apparatus may further include a blowing device disposed to generate an air flow to discharge byproduct generated from the developing unit away from the developing unit and to cool the other end of the heat plate.

The fixing device may include a heating source and a fixing device housing to accommodate the heating source, and the heat plate may be disposed to receive the heat directly from the heating source or to receive the heat through the fixing device housing.

The apparatus may further include a main body having front and rear portions to accommodate the developing unit and the fixing device therebetween, a discharge portion to discharge the printing medium with the developed image in a discharge direction from the rear portion toward the front portion, and side portions disposed between the front portion and the rear portion. The heat of the heat plate may be discharged toward an outside of the main body through one of the side portions of the main body.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
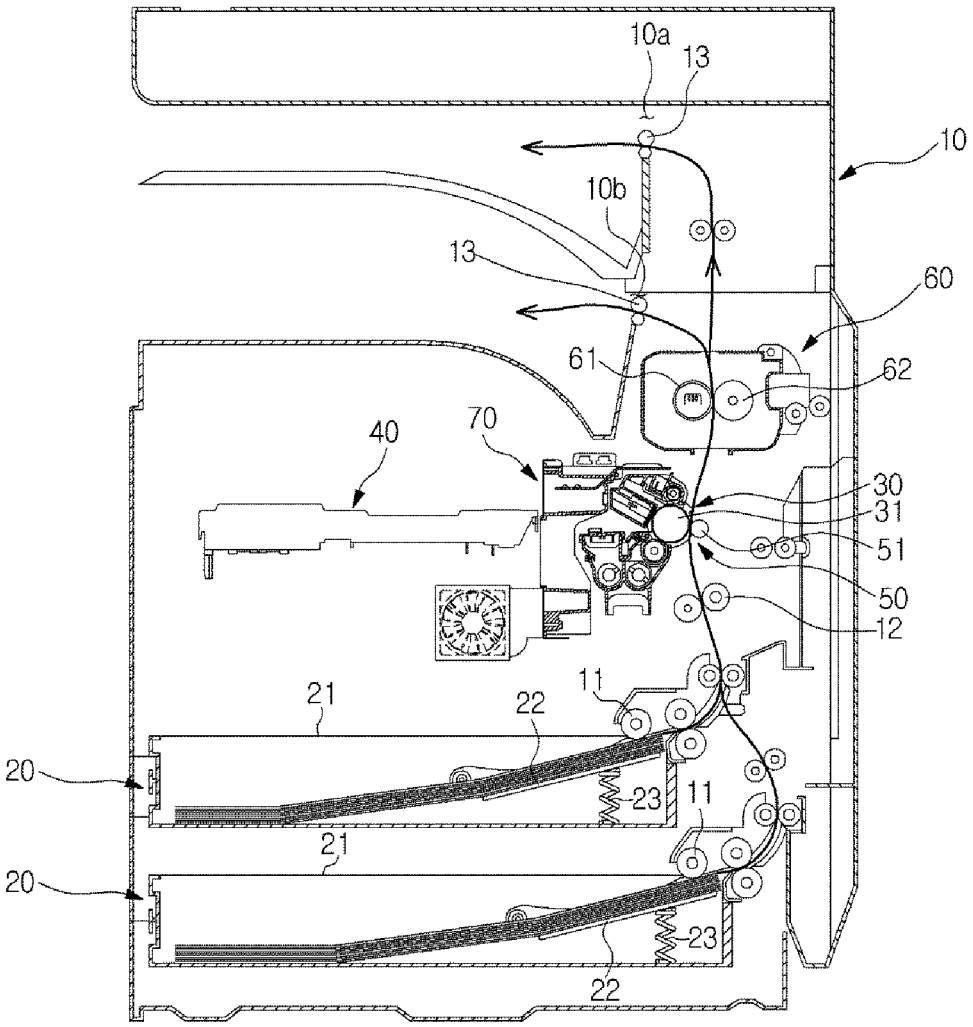
FIG. 1 is a schematic diagram illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The image forming apparatus according to the embodiment of the present general inventive concept, as illustrated in FIG. 1, includes a main body 10 defining an external appearance thereof, a printing media supply unit 20 to supply printing media, a developing unit 30 to develop an electrostatic latent image into a mono or colored visible image using developer, an exposure unit 40 to form the electrostatic latent image by irradiating light to a photoconductor 31 of the charged developing unit 30, a transfer device 50 to transfer the visible image, i.e. developer image, formed on the photoconductor 31 of the developing unit 31, to a printing medium transmitted from the printing media supply unit 20, and a fixing device 60 to fix the transferred developer image (or developed image) to the printing medium.

The printing media supply unit 20 includes a printing media cassette 21 movably installed or detachably attached to the main body 10, a knock-up plate 22 placed in the printing media cassette 21 such that at least one printing medium is loaded on the knock-up plate 22, and an elastic member 23 configured to elastically support the knock-up plate 22. In the present embodiment, two printing media supply units 20 are arranged at upper and lower positions to supply different sizes of printing media.

Figure 2:
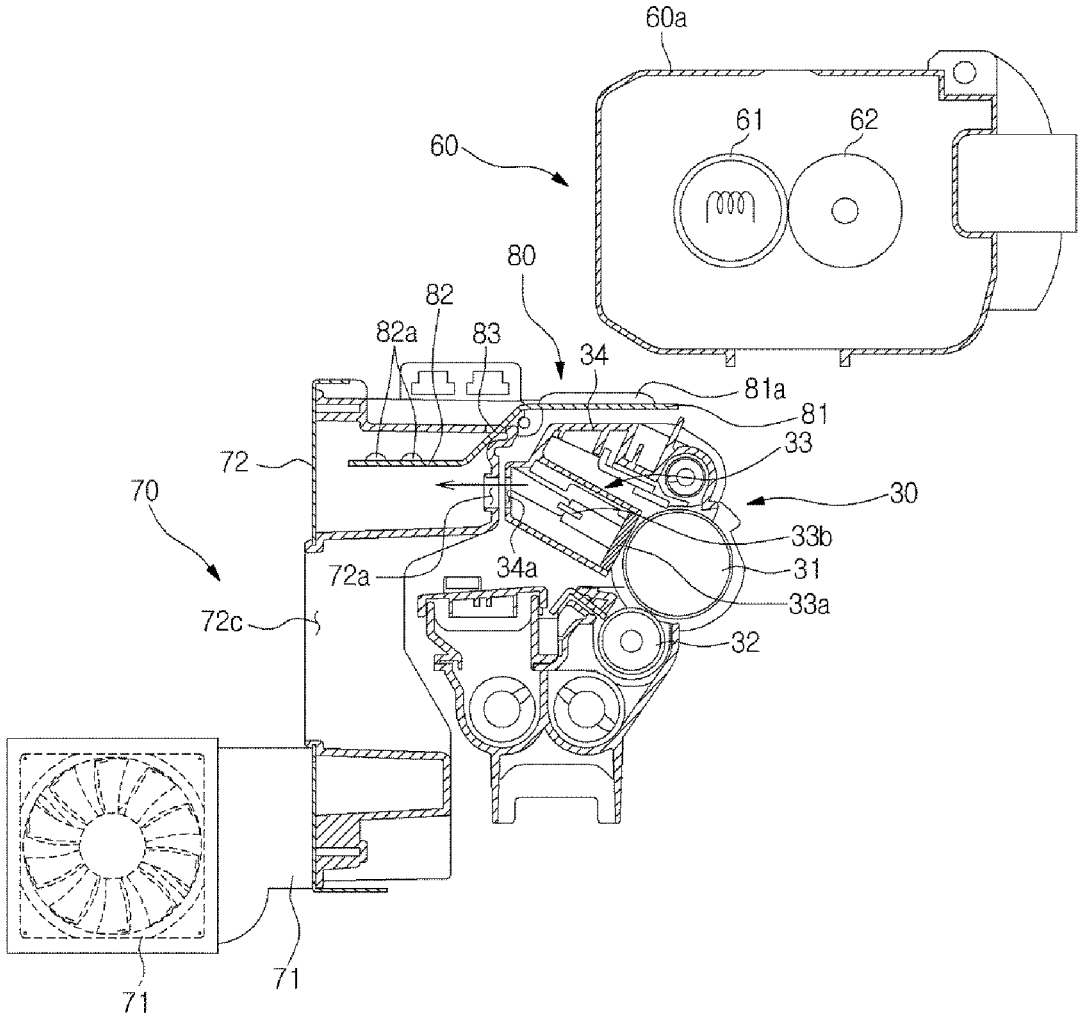
FIG. 2 is a side view illustrating a developing unit, fixing device, and blowing device included in the image forming apparatus of FIG. 1 according to an embodiment of the present general inventive concept.

Referring to FIGS. 1 and 2, the developing unit 30 includes the photoconductor 31 on which the electrostatic latent image is formed by the exposure unit 40, a developing roller 32 to feed developer to the photoconductor 31, a charging device 33 to charge a surface of the photoconductor 31, and a developing housing 34 defining an external appearance of the developing unit 30 to accommodate the photoconductor 31, developing roller 32, and charging device 34 therein. Here, the charging device 33 may include a first electrode 33*a* having one surface to be spaced apart from the photoconductor 31 so as to face the photoconductor 31, the first electrode 33*a* having a lattice shape, and a second electrode 33*b* disposed to face the other surface of the first electrode 33*a*, the second electrode 33*b* having a pin shape. The surface of the photoconductor 31 is charged to a constant potential as corona discharge occurs between the first electrode 33*a* and the second electrode 33*b*.

The exposure unit 40 forms the electrostatic latent image on the surface of the photoconductor 31 by irradiating light containing image information to the photoconductor 31 of the developing unit 30.

The transfer device 50 includes a transfer roller 51 to transfer the visible image formed on the photoconductor 31 to the printing medium.

The fixing device 60 includes a heating roller 61 to generate heat, and a pressure roller 62 having an outer peripheral surface formed of an elastically deformable material, the pressure roller 62 serving to press the printing medium against the outer peripheral surface of the heating roller 61. The fixing device 60 may include a fixing device housing 60*a* to accommodate the heating roller 61 and the pressure roller 62, to receive a printing medium to be fed along a path between the heating roller 61 and the pressure roller 62 and to discharge the printing medium with the fixed developer image. However, the present general inventive concept is not limited thereto. It is possible that the heating roller 61 and the pressure roller 62 can be installed in the main body without the fixing device housing 60*a*. It is also possible that the fixing device housing 60*a* may cover portions of the heating roller 61 and the pressure roller 62. It is also possible that the fixing device housing 60*a* may transmit heat generated from the heating roller 61 to an outside of the fixing device housing 60*a*.

The image forming apparatus may include a blowing device 70 to suction air from the developing unit 30 and expels discharge byproducts, such as ozone or nitrogen oxide, generated during an operation of the charging device 33 of the developing unit 30, from the main body 10 along with the air.

Figure 3:
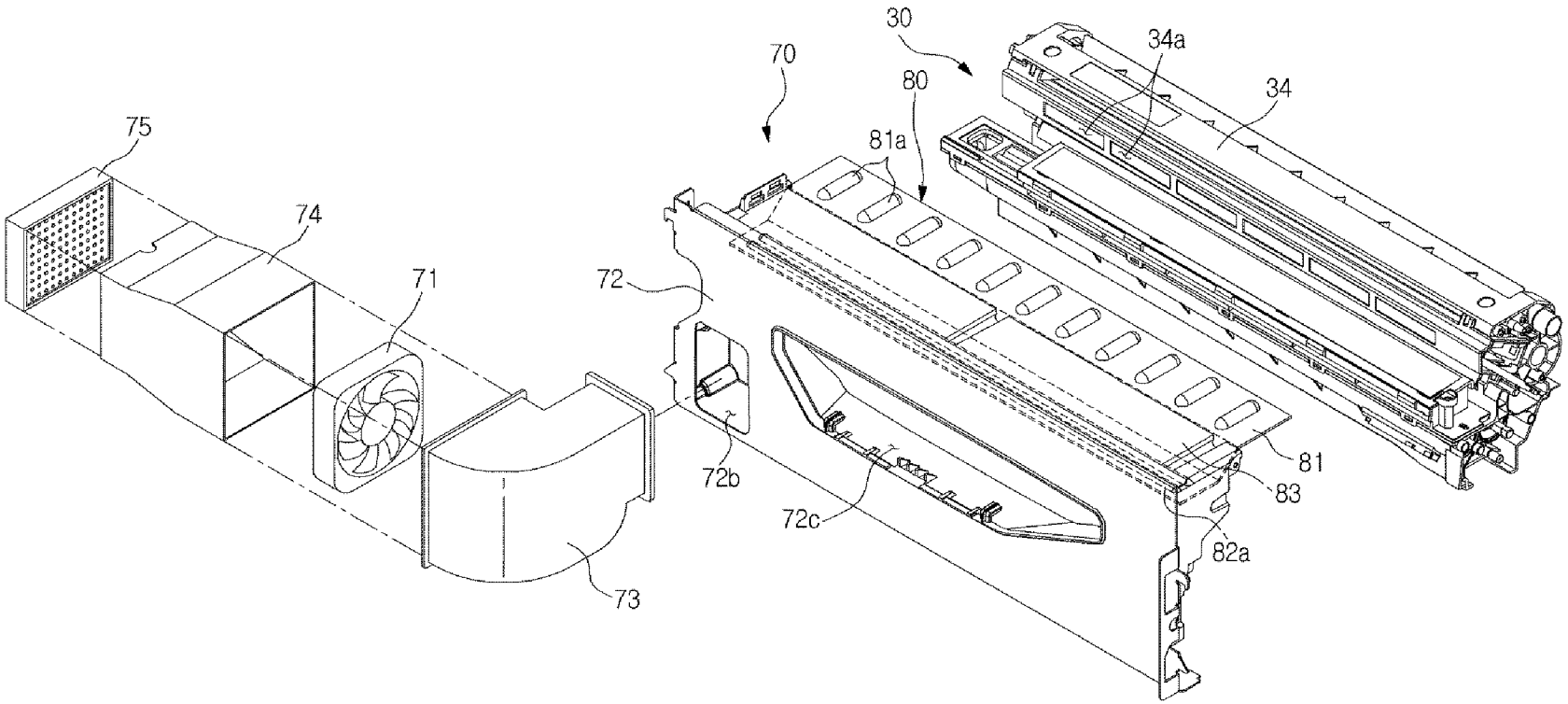
FIG. 3 is an exploded perspective view illustrating the developing unit and the blowing device included in the image forming apparatus of FIG. 1 according to an embodiment of the present general inventive concept.

Referring to FIGS. 2 and 3, the blowing device 70 includes a blowing fan 71 to provide a force to suction and discharge air according to rotation of one or more fans by a fan motor thereof, a plurality of ducts including a suction duct 72, a connection duct 73, and a discharge duct 74, and a filter 75 provided at a portion of the blowing device 70, for example, at a distal end of the discharge duct 74 to filter the discharge byproducts. The suction duct 72 has a width equivalent to that of the developing unit 30 in a width direction perpendicular to a feeding direction of the printing medium, and internally defines an air path, into which the discharge byproducts generated by the charging device 33 are suctioned along with the air. One end of the connection duct 73 is connected to the suction duct 72, and the other end of the connection duct 73 is connected to the blowing fan 71, such that the discharge byproducts and air suctioned into the suction duct 72 are directed to the blowing fan 71 through the connection duct 73. The discharge duct 74 guides discharge of the discharge byproducts and air from the blowing fan 71 to the outside of the main body 10. Here, the suction duct 72 has a suction port 72*a* at a position corresponding to the charging device 33, and the developing housing 34 has a discharge port 34*a* at a position corresponding to the suction port 72*a* for discharge of the discharge byproducts. The above-described charging device 33 is located inside the developing housing 34 to communicate with the discharge port 34*a* of the developing housing 34. The suction duct 72 further has a communication hole 72*b* to which the connection duct 73 is connected, and a through-hole 72*c* to allow light irradiated from the exposure unit 40 to reach the photoconductor 31 of the developing unit 30 through the suction duct 72.

After the discharge byproducts generated by the charging device 33 are suctioned along with the air enter into the suction duct 72 through the discharge port 34*a* and the suction port 72*a* in an arrow direction of FIG. 2, the suctioned discharge byproducts move through the suction duct 72 to thereby be directed into the connection duct 73 connected to the communication hole 72*b* of the suction duct 72. Then, as illustrated in FIG. 4, as the discharge byproducts are suctioned into the blowing fan 71 connected to the connection duct 73 and pass through the discharge duct 74, the discharge byproducts are finally filtered by the filter 75 located at the distal end of the discharge duct 74.

Referring to FIG. 1, the main body 10 has one or more printing media discharge openings 10*a* and 10*b*, from which printing media on which images have completely been formed are discharged. Provided additionally within the main body 10 are pickup rollers 11 disposed above the printing media supply units 20 to pick up the printing media loaded on the knock-up plates 22, delivery rollers 12 to guide the printing media picked up by the pickup rollers 11 upward, and one or more discharge rollers 13 disposed above the fixing device 60 at positions close to one or more discharge openings 10*a* and 10*b* to discharge the printing media having passed through the fixing device 60 from the corresponding discharge openings 10*a* and 10*b*.

Figure 4:
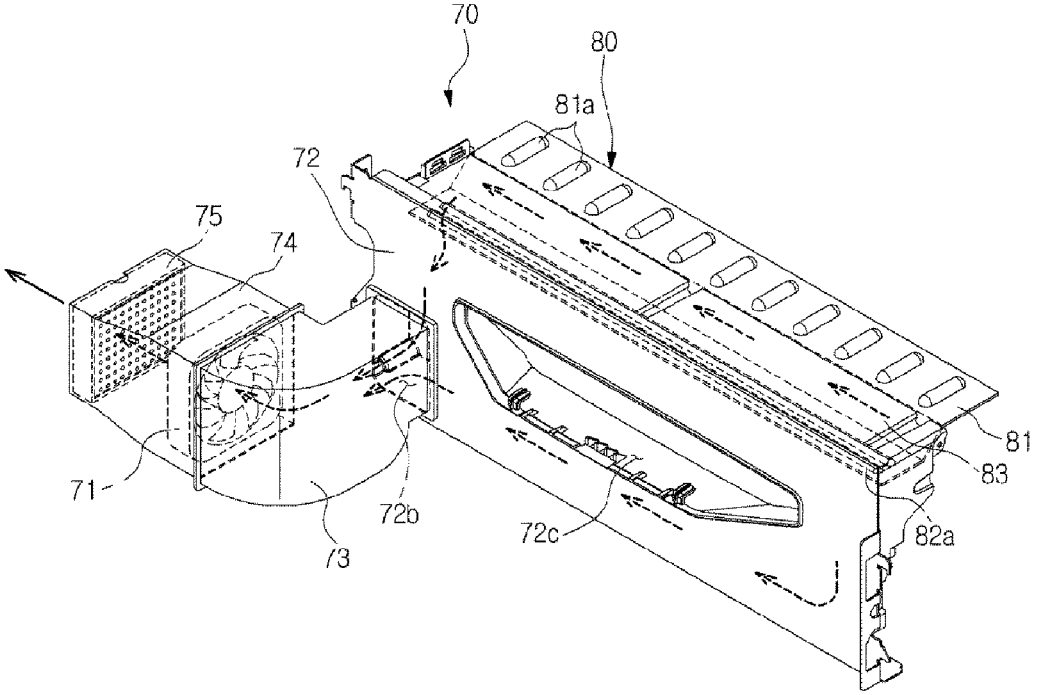
FIG. 4 is a perspective view illustrating the developing unit and the blowing device included in the image forming apparatus of FIG. 1 according to an embodiment of the present general inventive concept.

Referring to FIGS. 2, 3, and 4, the image forming apparatus further includes a heat plate 80 located between the developing unit 30 and the fixing device 60 to restrict transmission of heat from the fixing device 60 to the developing unit 30. The heat plate 80 is formed of a metal material for easy heat transmission. The heat plate 80 includes a shield section 81 located between a top of the developing unit 30 and a bottom of the fixing device 60 to absorb heat transmitted from the fixing device 60 to restrict transmission of heat to the developing unit 30, a radiator section 82 to integrally extend from the shield section 81 to be cooled via heat exchange with air, and a connecting section 83 to extend to connect the shield section 71 and the radiator section 82 to each other. The connecting section 83 may not be disposed on a straight line but be disposed along a curved or bent line direction or disposed obliquely to change or direct a flow direction of the air. The shield section 81 may be disposed to efficiently receive heat emitted from the fixing device 60. The shield section 81 may be disposed on a same side as the heating roller 61 with respect to a feeding path of the printing medium. The shield section 81 may have a width parallel to a rotation axis of the developing unit 30 or the fixing device 60. The width of the shield section 81 may be narrower than a width of the developing unit 30 or the fixing device 60. It is possible that the width of the shield section 81 may be narrower than a width of the photoconductor 31 of the developing unit 30 or the heating roller 61 of the fixing device 60. The shield section 81 may be disposed on a portion of the developing housing 34, may be formed as a portion of the developing housing 34, or may extend or protrude from a portion of the developing housing 34 toward the feeding path of the printing medium.

In the present embodiment, the radiator section 82 of the heat plate 80 is located within the suction duct 72 to ensure more rapid radiation of heat, thereby being cooled via heat exchange with air passing through the suction duct 72. That is, the blowing device 70 serves not only to discharge the discharge byproducts generated by the charging device 33 to the outside of the main body 10, but also to cool the heat plate 80 so as to restrict transmission of heat from the fixing device 60 to the developing unit 30.

When heat is transmitted from the fixing device 60 to the developing unit 30, a large part of the heat is absorbed by the shield section 81 of the heat plate 80. After the heat is transmitted to the radiator section 82 placed within the suction duct 72 through the connecting section 83, the heat is absorbed by the air passing through the suction duct 72, thereby being discharged outward from the main body 10 by sequentially passing through the connection duct 73, blowing fan 71, and discharge duct 74. As such, transmission of heat from the fixing device 60 to the developing unit 30 is restricted by the heat plate 80, which assists the developing unit 30 in remaining below a predetermined temperature, and prevents decomposition of developer within the developing unit 30.

The shield section 81 of the heat plate 80 is provided with a plurality of heat absorbing ridges 81*a* to increase a heat exchange area. The heat absorbing ridges 81*a* integrally protrude from a major surface of the shield section 81 toward the fixing device 60 to ensure easy absorption of heat from the fixing device 60. Also, the radiator section 82 is provided with a plurality of heat radiating ridges 82*a* to increase a heat exchange area. The heat radiating ridges 82*a* integrally protrude from a major surface the radiator section 82 to be disposed in the internal path of the suction duct 72 to provide a more efficient cooling effect to the radiator section 82 via heat exchange with the air passing through the suction duct 72.

Although the present embodiment describes the connecting section 83 as being present between the shield section 81 and the radiator section 82 for convenience of description, the present general inventive concept is not limited thereto. It is possible that the shield section 81 and the radiator section 82 are directly connected to each other.

As is apparent from the above description, according to the embodiments of the present invention, providing a heat plate between a fixing device and a developing unit to absorb heat to be transmitted from the fixing device to the developing unit may prevent heat generated from the fixing device from being transmitted to the developing unit.

Further, as described above, providing a blowing device to suction and filter discharge byproducts generated by a charging device may ensure outward discharge of corona-discharge byproducts from a main body of an image forming apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a main body defining an external appearance of the image forming apparatus;

a developing unit to form a visible image on a printing medium using developer;

a fixing device to fix the developer image to the printing medium;

a heat plate having a first portion placed between the developing unit and the fixing device to absorb heat and a second portion to discharge the heat having an end disposed further from the fixing device than the developing unit such that the end extends away from the fixing device and the developing unit, the first portion of the heat plate includes a shield section located between the developing unit and the fixing device, and the second portion of the heat plate includes a radiator section integrally extending from the shield section, the radiator section being cooled via heat exchange with air; and a blowing device to allow the radiator section to be cooled in contact with air, wherein the blowing device includes a blowing fan, a suction duct having a width equivalent to a width of the developing unit, into which air is suctioned from the developing unit, a connection duct to connect the suction duct and the blowing fan to each other, and a discharge duct to guide the air discharged from the blowing fan to an outside of the main body.

2. The apparatus according to claim 1, wherein the heat plate further includes a connecting section to connect the shield section and the radiator section to each other.

3. The apparatus according to claim 1, wherein the radiator section is located within the suction duct and is cooled by the air passing through the suction duct.

4. The apparatus according to claim 1, wherein:

the developing unit includes a photoconductor and a charging device to charge the photoconductor; and the blowing device is configured to suction discharge byproducts generated from the charging device and discharge the discharge byproducts to the outside of the main body.

5. The apparatus according to claim 4, wherein:

the suction duct has a suction port at a position corresponding to the charging device; and the developing unit includes a developing housing provided with a discharge port at a position corresponding to the suction port, and the charging device is located inside the discharge port of the developing housing.

6. The apparatus according to claim 5, wherein the charging device includes a first electrode having a lattice shape, one surface of the first electrode being spaced apart from the photoconductor so as to face the photoconductor, and a second electrode having a pin shape, the second electrode being spaced apart from the other surface of the first electrode.

7. The apparatus according to claim 1, wherein the shield section includes a plurality of heat absorbing ridges protruding toward the fixing device.

8. The apparatus according to claim 1, wherein the radiator section includes a plurality of heat radiating ridges protruding into an internal path of the suction duct.

9. An image forming apparatus comprising:

a main body defining an external appearance of the image forming apparatus;

a developing unit placed within the main body and serving to form a visible image on a printing medium using developer; and a blowing device to suction air from the developing unit and to discharge the air to an outside of the main body such that the air flows in a duct of the blowing device, wherein the developing unit includes a photoconductor and a charging device to charge the photoconductor, and wherein the blowing device is to suction discharge byproducts generated from the charging device and discharge the discharge byproducts to the outside of the main body such that the byproducts are moved in the duct, wherein the blowing device includes a blowing fan, and the duct that has a suction duct having a suction port corresponding to the charging device and configured to suction the air from the charging device, a connection duct to connect the suction duct and the blowing fan to each other.

10. The apparatus according to claim 9, wherein:

the blowing device further includes a discharge duct to guide the air discharged from the blowing fan to the outside of the main body; and the developing unit includes a developing housing provided with a discharge port at a position corresponding to the suction port, and the charging device is located inside the discharge port of the developing housing.

11. The apparatus according to claim 9, wherein the charging device includes a first electrode having a lattice shape, one surface of the first electrode being spaced apart from the photoconductor so as to face the photoconductor, and a second electrode having a pin shape, the second electrode being spaced apart from the other surface of the first electrode.

12. The apparatus according to claim 9, further comprising:

a fixing device to fix the developer to the printing medium; and a heat plate placed between the developing unit and the fixing device, wherein the heat plate includes a shield section located between the developing unit and the fixing device, and a radiator section integrally extending from the shield section, the radiator section being cooled via heat exchange with air.

13. An image forming apparatus comprising:

a main body defining an external appearance of the image forming apparatus;

a developing unit to form a visible image on a printing medium using developer;

a fixing device to fix the developer image to the printing medium;

a heat plate having one end disposed close to the fixing device to absorb heat from the fixing device and the other end extended from the one end toward a position away from the fixing device and the developing unit such that the other end of the heat plate is disposed further from the fixing device than the developing unit and the heat is discharged away from the fixing device and the developing unit through the other end of the heat plate, and a blowing device disposed to generate an air flow to discharge byproduct generated from the developing unit away from the developing unit and to cool the other end of the heat plate, wherein the blowing device includes a blowing fan, a suction duct having a width equivalent to a width of the developing unit, into which air is suctioned from the developing unit, a connection duct to connect the suction duct and the blowing fan to each other, and a discharge duct to guide the air discharged from the blowing fan to an outside of the main body.

14. The apparatus of claim 13, wherein the heat plate is disposed in the air flow for heat exchange.

15. The apparatus of claim 13, wherein:

the fixing device comprises a heating source and a fixing device housing to accommodate the heating source; and the heat plate is disposed to absorb the heat directly from the heating source or to absorb the heat through the fixing device housing.

16. The apparatus of claim 13, wherein the main body comprises front and rear portions to accommodate the developing unit and the fixing device therebetween, a discharge portion to discharge the printing medium with the developed image in a discharge direction from the rear portion toward the front portion, and side portions disposed between the front portion and the rear portion, and wherein the heat of the heat plate is discharged toward an outside of the main body through one of the side portions of the main body.

* * * * *